US011964839B2

(12) United States Patent
Wada et al.

(10) Patent No.: US 11,964,839 B2
(45) Date of Patent: Apr. 23, 2024

(54) CONVEYANCE ROUTE SWITCHING MECHANISM AND PAPER SHEET HANDLING APPARATUS

(71) Applicant: FUJITSU FRONTECH LIMITED, Tokyo (JP)

(72) Inventors: Takashi Wada, Inagi (JP); Tomoyuki Tamahashi, Inagi (JP); Satoshi Hayashi, Inagi (JP); Atsushi Ando, Inagi (JP); Shohei Koizumi, Inagi (JP); Shoichi Deguchi, Inagi (JP); Akira Yamada, Inagi (JP)

(73) Assignee: FUJITSU FRONTECH LIMITED, Inagi (JP)

( * ) Notice: Subject to any disclaimer, the term of this patent is extended or adjusted under 35 U.S.C. 154(b) by 62 days.

(21) Appl. No.: 17/930,580

(22) Filed: Sep. 8, 2022

(65) Prior Publication Data

US 2023/0002182 A1 Jan. 5, 2023

Related U.S. Application Data

(63) Continuation of application No. PCT/JP2020/012132, filed on Mar. 18, 2020.

(51) Int. Cl.

| | |
|---|---|
| ***B65H 29/60*** | (2006.01) |
| ***B65H 5/26*** | (2006.01) |
| ***B65H 29/58*** | (2006.01) |

(52) U.S. Cl.

CPC ..... *B65H 29/60* (2013.01); *B65H 5/26* (2013.01); *B65H 29/58* (2013.01);

(Continued)

(58) Field of Classification Search

CPC ..... B65H 29/58; B65H 29/585; B65H 29/60; B65H 29/62; B65H 29/64; B65H 2404/63;

(Continued)

(56) References Cited

U.S. PATENT DOCUMENTS

| | | | | |
|---|---|---|---|---|
| 5,927,713 | A | 7/1999 | Driscoll et al. | |
| 7,594,655 | B2 * | 9/2009 | Wu | B65H 3/0661 271/3.14 |

(Continued)

FOREIGN PATENT DOCUMENTS

| | | | |
|---|---|---|---|
| EP | 2664568 | A1 | 11/2013 |
| JP | 10006617 | A | 1/1998 |

(Continued)

OTHER PUBLICATIONS

Written Opinion of the ISA issued in PCT/JP2020/012132, dated Jun. 9, 2020.

(Continued)

*Primary Examiner* — Jeremy R Severson

(74) *Attorney, Agent, or Firm* — Greer Burns & Crain Ltd.

(57) ABSTRACT

A conveyance route switching mechanism and a paper sheet handling apparatus that includes the conveyance route switching mechanism include a driving source, a gate, a first gear, and an internal gear. The driving source includes a driving shaft. The gate includes a gate shaft, and a blade that is provided on the gate shaft, and switches conveyance routes of paper sheets. The first gear is provided on the gate shaft. The internal gear meshes with the first gear. According to rotation of the driving shaft, the gate shaft rotates on an axis of the gate shaft, and revolves with the driving shaft as a rotation center while the first gear meshes with the internal gear.

5 Claims, 7 Drawing Sheets

(52) U.S. Cl.
CPC .. *B65H 2301/3125* (2013.01); *B65H 2403/41* (2013.01); *B65H 2403/481* (2013.01); *B65H 2403/942* (2013.01); *B65H 2404/632* (2013.01); *B65H 2513/42* (2013.01); *B65H 2701/1912* (2013.01)

(58) Field of Classification Search
CPC ..... B65H 2404/631; B65H 2404/632; B65H 2404/633; B65H 2513/42; B65H 2403/41; B65H 2403/481
See application file for complete search history.

(56) References Cited

U.S. PATENT DOCUMENTS

| | | | |
|---|---|---|---|
| 9,656,819 | B2 | 5/2017 | Yamada |
| 2015/0108715 | A1 | 4/2015 | Yamada |
| 2019/0127164 | A1 | 5/2019 | Furusawa et al. |

FOREIGN PATENT DOCUMENTS

| | | | |
|---|---|---|---|
| JP | 2015098399 | A | 5/2015 |
| JP | 2016147751 | A | 8/2016 |
| JP | 2019081658 | A | 5/2019 |

OTHER PUBLICATIONS

ISR issued in in PCT/JP2020/012132, dated Jun. 9, 2020.
1 Search report issued in corresponding European patent application No. EP20 925 695.7, dated Nov. 13, 2023.

* cited by examiner

CONVEYANCE ROUTE SWITCHING MECHANISM AND PAPER SHEET HANDLING APPARATUS

CROSS-REFERENCE TO RELATED APPLICATION

This application is continuation application of International Application PCT/JP2020/012132 filed on Mar. 18, 2020 and designated the U.S., the entire contents of which are incorporated herein by reference.

TECHNICAL FIELD

The present invention relates to a conveyance route switching mechanism and a paper sheet handling apparatus.

BACKGROUND ART

Conventionally, a conveyance switching apparatus has been proposed where one driving means causes two conveyance switching blades to be interlocked with each other and rotate in a merging part where three conveyance paths merge (see, for example, Japanese Laid-open Patent Publication No. 2016-147751).

SUMMARY OF INVENTION

A conveyance route switching mechanism of the disclosure includes a driving source, a gate, a first gear, and an internal gear. The driving source includes a driving shaft. The gate includes a gate shaft, and a blade that is provided on the gate shaft, and switches conveyance routes of paper sheets. The first gear is provided on the gate shaft. The internal gear meshes with the first gear. According to rotation of the driving shaft, the gate shaft rotates on an axis of the gate shaft, and revolves with the driving shaft as a rotation center while the first gear meshes with the internal gear.

A paper sheet handling apparatus of the disclosure is a paper sheet handling apparatus that includes a conveyance route switching mechanism, and the conveyance route switching mechanism includes a driving source, a gate, a first gear, and an internal gear. The driving source includes a driving shaft. The gate includes a gate shaft, and a blade that is provided on the gate shaft, and switches conveyance routes of paper sheets. The first gear is provided on the gate shaft. The internal gear meshes with the first gear. According to rotation of the driving shaft, the gate shaft rotates on an axis of the gate shaft, and revolves with the driving shaft as a rotation center while the first gear meshes with the internal gear.

The object and advantages of the present invention will be realized by the elements set forth in the claims or combinations thereof.

DESCRIPTION OF EMBODIMENTS

In a paper sheet handling apparatus such as an automated teller machine (ATM), conveyance routes of paper sheets are complicatedly switched, for example, in such a way that in a position where three conveyance paths cross each other, a conveyance route is switched between a conveyance route that connects one conveyance path and two remaining conveyance paths and a conveyance route that connects another conveyance path and two remaining conveyance paths, and therefore the number of conveyance paths can be reduced in the paper sheet handling apparatus. This enables space saving.

However, in order to complicatedly switch conveyance routes, as described above, in a position where three conveyance paths cross each other, a plurality of gates is combined and used. Therefore, space fails to be saved from the point of view of the use of a plurality of gates.

For example, in the conveyance switching apparatus described above, one driving means is used. However, two conveyance switching blades are used, and therefore space fails to be saved. Further, in the conveyance switching apparatus described above, one driving means causes two conveyance switching blades to be interlocked with each other, and therefore conveyance routes fail to be complicatedly switched, as described above, in a position where three conveyance paths cross each other.

A conveyance route switching mechanism and a paper sheet handling apparatus according to an embodiment of the present invention are described below with reference to the drawings by using, as an example, a conveyance route switching mechanism 1 and an automated transaction apparatus 100.

Figure 1:
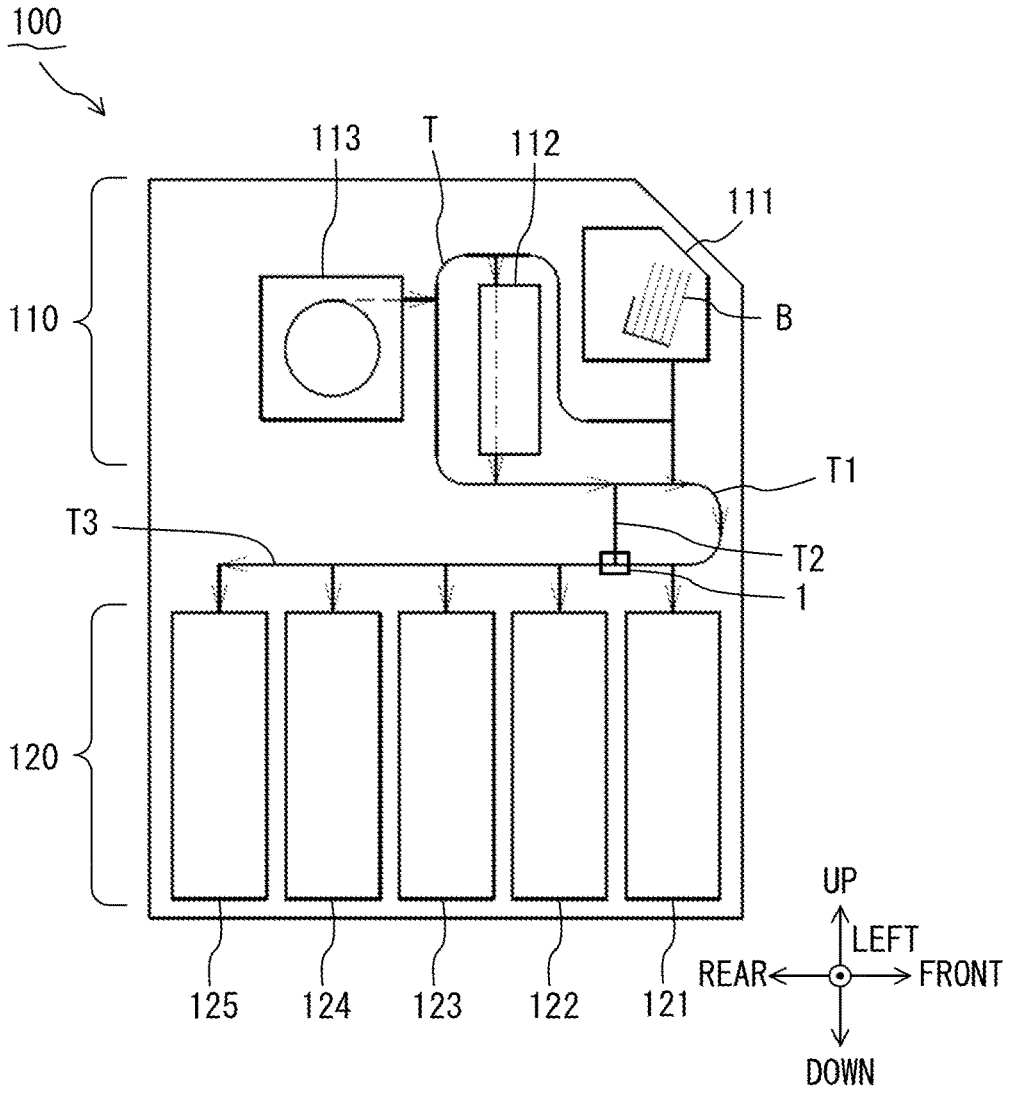
FIG. 1 is a diagram illustrating an internal configuration of an automated transaction apparatus according to an embodiment (at the time of deposits).

FIG. 1 is a diagram illustrating an internal configuration of the automated transaction apparatus 100 (at the time of deposits).

Figure 2:
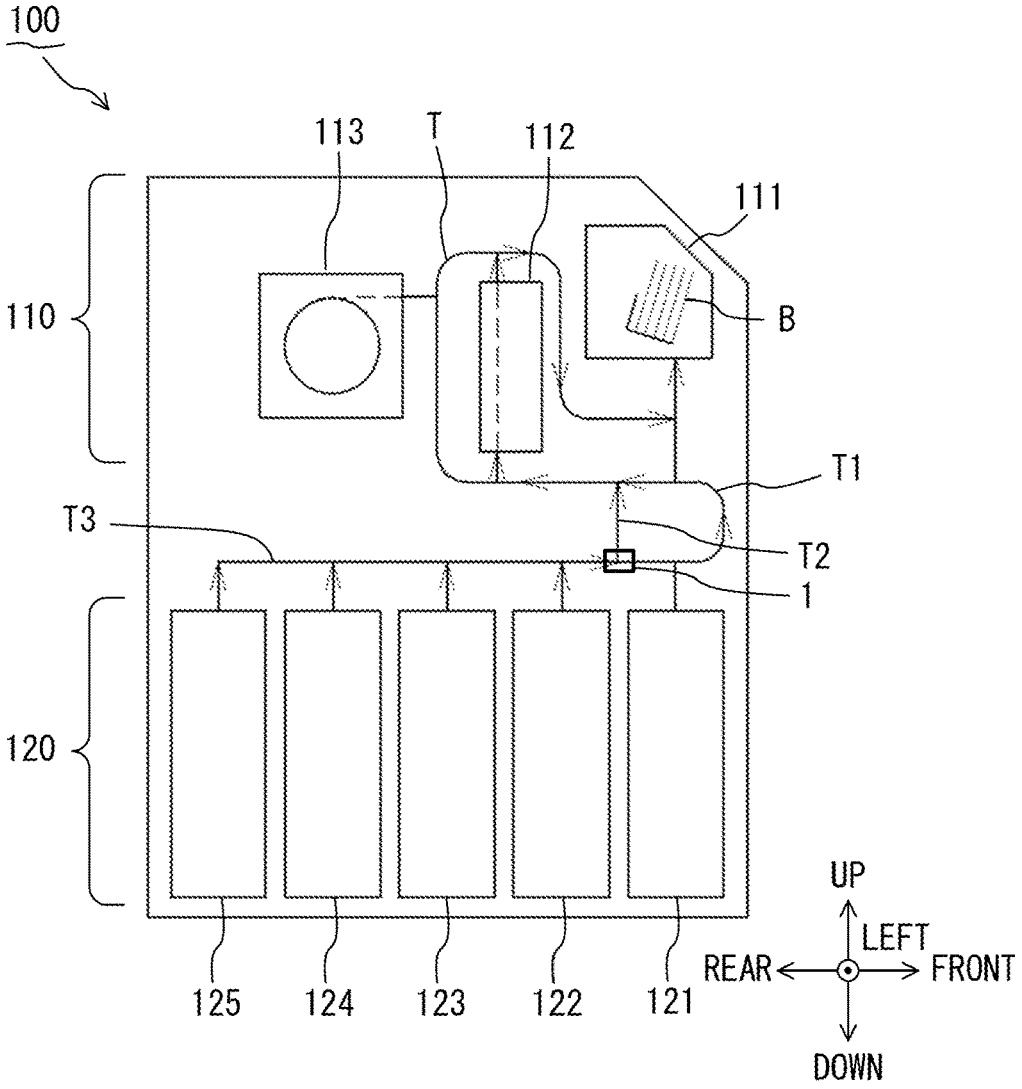
FIG. 2 is a diagram illustrating an internal configuration of an automated transaction apparatus according to an embodiment (at the time of withdrawals).

FIG. 2 is a diagram illustrating an internal configuration of the automated transaction apparatus 100 (at the time of withdrawals).

Note that each of the upward/downward, forward/backward, and leftward/rightward directions illustrated in FIGS. 1 and 2 and FIGS. 3 to 7 described below is only an example in a case where it is assumed that a customer side of the automated transaction apparatus 100 is a forward direction. However, for example, the upward/downward direction is a vertical direction, and the forward/backward direction and the leftward/rightward direction are horizontal directions.

The automated transaction apparatus 100 illustrated in FIGS. 1 and 2 is, for example, an ATM, a bill recycle unit (BRU), a cash dispenser (CD), a teller cash recycler (TCR), or the like, and includes the conveyance route switching mechanism 1, a body 110, and a storage 120. Banknote B that is an example of a paper sheet is conveyed through a conveyance path T in the automated transaction apparatus 100.

Details of the conveyance route switching mechanism 1 will be described below, but the conveyance route switching mechanism 1 is disposed in a position where three conveyance paths in total, for example, a first conveyance path T1 and a second conveyance path T2 that connect the body 110 and the storage 120, and a third conveyance path T3 that is connected to banknote storage cassettes 122 to 125, cross each other on the conveyance path T in the automated transaction apparatus 100. Note that the conveyance route switching mechanism 1 can be disposed in an arbitrary position where three or more conveyance paths cross each other.

The body 110 includes a banknote deposit/withdrawal part 111, a discrimination part 112, and a temporary holding part 113.

At the time of deposits, banknote B that is an example of a paper sheet is inserted into the banknote deposit/withdrawal part 111, and at the time of withdrawals, banknote B is ejected from the banknote deposit/withdrawal part 111.

The discrimination part 112 determines authenticity, stains, corner folding, or the like of banknote B.

The temporary holding part 113 temporarily stores banknote B that the discrimination part 112 has determined to be normal, for example, by winding up the banknote B.

The storage 120 includes a reject part 121 and a plurality of banknote storage cassettes 122 to 125.

The reject part 121 stores, for example, banknote B that will not be returned from among pieces of banknote B that the discrimination part 112 has determined to be abnormal.

The banknote storage cassettes 122 to 125 store, for example, pieces of banknote B that are different in type from each other. The banknote storage cassettes 122 to 125 can eject stored banknote B. Therefore, banknote B stored in the banknote storage cassettes 122 to 125 is used for withdrawals.

As an example, at the time of deposits illustrated in FIG. 1, banknote B that has been inserted into the banknote deposit/withdrawal part 111 is conveyed to the discrimination part 112. Then, banknote B that the discrimination part 112 has determined to be normal is conveyed to the temporary holding part 113. This banknote B that is temporarily stored in the temporary holding part 113 is conveyed through the first conveyance path T1 and the third conveyance path T3 to any of the banknote storage cassettes 122 to 125. In contrast, banknote B (counterfeit banknote or the like) that the discrimination part 112 has determined to be abnormal is not conveyed to the temporary holding part 113, but is conveyed through the first conveyance path T1 to the reject part 121.

In addition, at the time of withdrawals illustrated in FIG. 2, banknote B stored in the banknote storage cassettes 122 to 125 is conveyed through the first conveyance path T1 or the second conveyance path T2 and the discrimination part 112 to the paper money deposit/withdrawal part 111.

Figure 3:
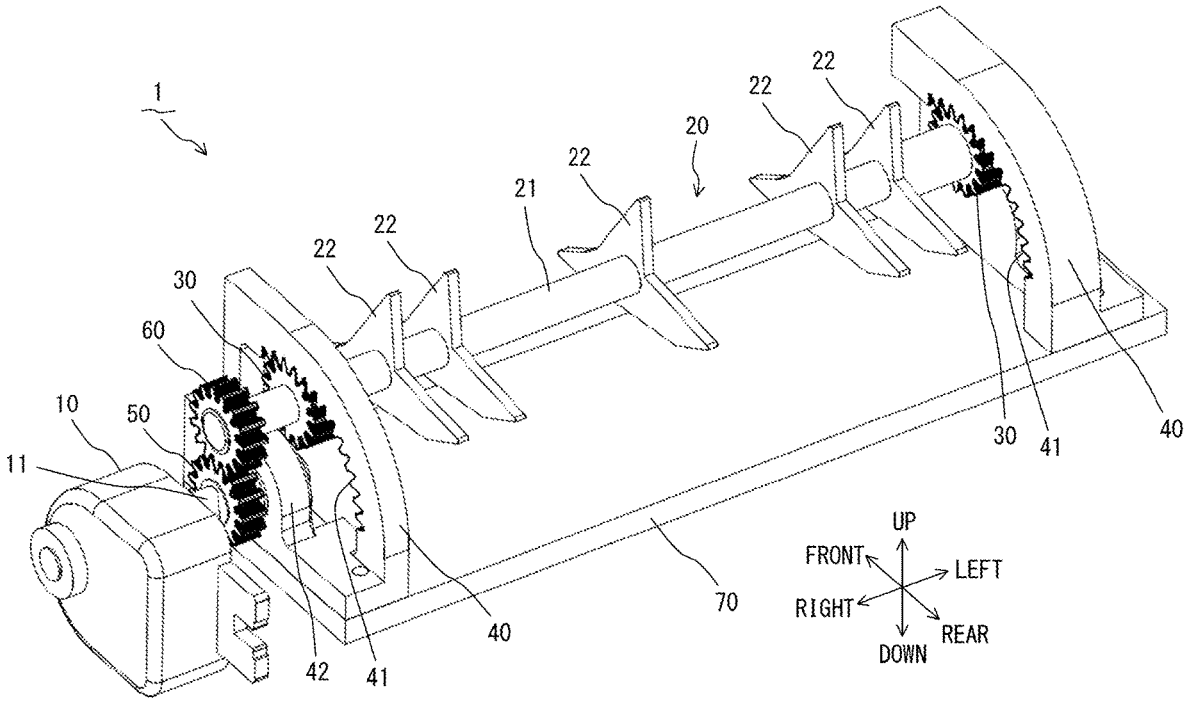
FIG. 3 is a perspective view of a conveyance route switching mechanism according to an embodiment when viewed from the above of a right rear side.

FIG. 3 is a perspective view of the conveyance route switching mechanism 1 when viewed from the above of a right rear side.

Figure 4:
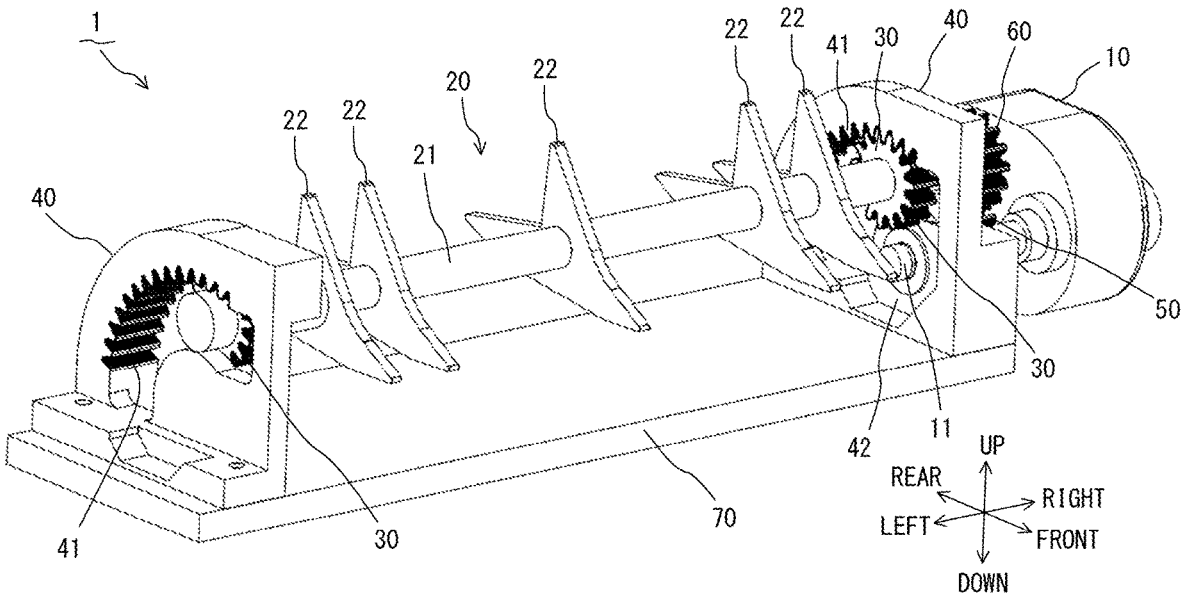
FIG. 4 is a perspective view of a conveyance route switching mechanism according to an embodiment when viewed from the above of a left front side.

FIG. 4 is a perspective view of the conveyance route switching mechanism 1 when viewed from the above of a left front side.

The conveyance route switching mechanism 1 includes a driving source 10, a gate 20, a pair of first gears 30, a pair of internal gears 40, a second gear 50, a third gear 60, and a base 70.

The driving source 10 is an actuator that includes a driving shaft 11, and is, for example, a rotary solenoid that rotates (swings) the driving shaft 11 within a range of a predetermined angle.

The gate 20 includes a gate shaft 21 and, for example, five blades 22 that are provided on this gate shaft 21, and the gate 20 switches conveyance routes of banknote B.

The gate shaft 21 extends in the leftward/rightward direction. At a right-hand end of the gate shaft 21, the third gear 60 is provided, and near a left-hand end and the right-hand end of the gate shaft 21, the pair of first gears 30 are provided.

One blade 22 of the five blades 22 is provided in a center in a width direction (the leftward/rightward direction) of a conveyance path T that is not illustrated in FIGS. 3 and 4 on the gate shaft 21. From among four other blades 22, two blades are provided on a side of a left-hand end of the conveyance path T, and two blades are provided on a side of a right-hand end of the conveyance path T on the gate shaft 21.

The blade 22 has, for example, a triangular plate shape having two sides recessed inward from among three sides. The blade 22 guides banknote B in a circumference (for example, the three sides). Note that the shapes of the blades 22 illustrated in FIGS. 3 and 4 are slightly different from the shapes of the blades 22 illustrated in FIGS. 5 to 7 described below. However, the blade 22 can have an arbitrary shape, and therefore the blade 22 may have any shape.

Each of the pair of first gears 30 is, for example, a spur gear, and is provided near the left-hand end or the right-hand end of the gate shaft 21, as described above. The pair of first gears 30 mesh with the pair of internal gears 40.

The pair of internal gears 40 are disposed to face each other in the leftward/rightward direction. Each of the pair of internal gears 40 is provided with teeth 41 within a range of about 90 degrees, and has a fan shape. Note that the internal gear 40 can have a fan shape if the teeth 41 are provided within a range that is less than 180 degrees.

From among the pair of internal gears 40, an internal gear 40 on a side of the driving source 10 (on a right-hand side) includes a bearing 42 that rotatably supports the driving shaft 11.

The second gear 50 is, for example, a spur gear that is provided on the driving shaft 11.

The third gear 60 is, for example, a spur gear that is provided at the right-hand end of the gate shaft 21, and meshes with the second gear 50.

The base 70 has a flat plate shape, and the pair of internal gears 40 are fixed at both left-hand and right-hand ends of an upper face of the base 70. The base 70 is disposed to be unable to move, and therefore the internal gears 40 that are fixed to this base 70 are also disposed to be unable to move.

In the conveyance route switching mechanism 1 described above, the second gear 50 that is provided on the driving shaft 11 meshes with the third gear 60 that is provided at the right-hand end of the gate shaft 21. However, the second gear 50 may mesh with the first gear 30 that is provided on the gate shaft 21. In this case, the third gear 60 can be omitted. This causes the driving source 10 to be closer to the internal gear 40 on a right-hand side, and the space of the conveyance route switching mechanism 1 can be saved.

In addition, the second gear 50 that is provided on the driving shaft 11 meshes with the third gear 60 that is provided on the gate shaft 21, and therefore the gate shaft 21 rotates on its axis according to the rotation of the driving shaft 11. For example, in a case where the driving shaft 11 and the gate shaft 21 are coupled by a power transmission means such as a belt, the second gear 50 and the third gear 60 can be omitted.

Switching of conveyance routes of the conveyance route switching mechanism 1 is described below.

Figure 5:
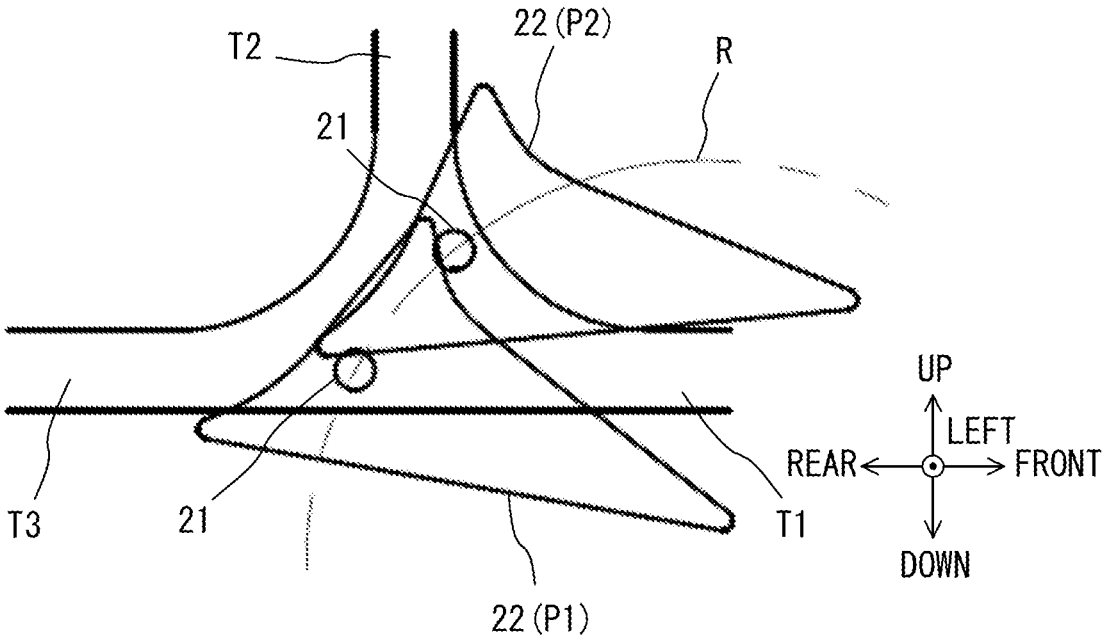
FIG. 5 is a diagram for explaining switching of conveyance routes according to an embodiment.

FIG. 5 is a diagram for explaining switching of conveyance routes.

Figure 6:
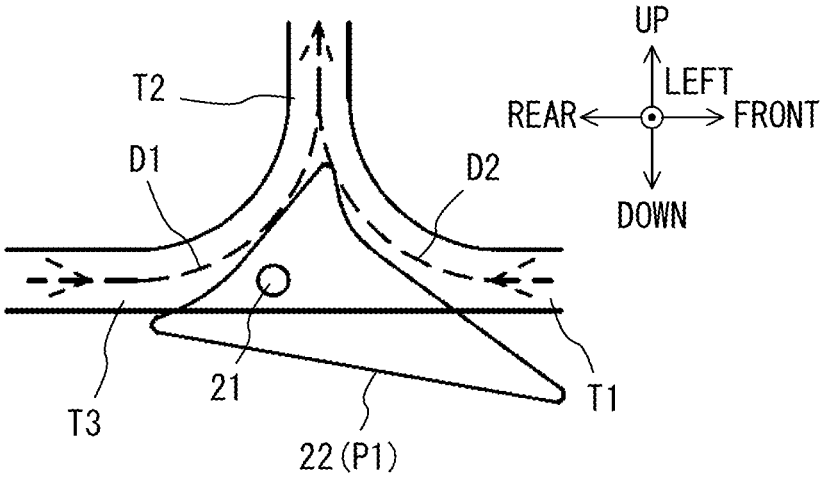
FIG. 6 is a diagram illustrating a blade that is located in a first position according to an embodiment.

FIG. 6 is a diagram illustrating a blade 22 that is located in a first position P1.

Figure 7:
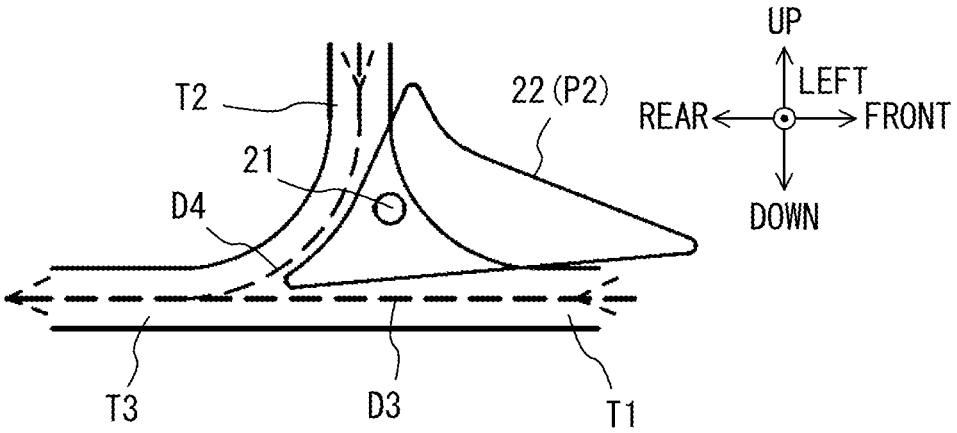
FIG. 7 is a diagram illustrating a blade that is located in a second position according to an embodiment.

FIG. 7 is a diagram illustrating a blade 22 that is located in a second position P2.

First, in the conveyance route switching mechanism 1 illustrated in FIGS. 3 and 4, when the driving source 10 rotates the driving shaft 11, the second gear 50 that is provided on this driving shaft 11 rotates. In addition, the third gear 60 that meshes with this second gear 50 rotates, and therefore the gate shaft 21 that is provided with the third gear 60 rotates. As described above, the gate shaft 21 rotates on its axis according to the rotation of the driving shaft 11.

In addition, according to the rotation of the gate shaft 21 on its axis, the pair of first gears 30 that are provided on this gate shaft 21 rotate. Therefore, according to the rotation of the driving shaft 11, the gate shaft 21 revolves along the revolution orbit R illustrated in FIG. 5 with the driving shaft 11 as a rotation center, while the pair of first gears 30 mesh with the pair of internal gears 40. As described above, the second gear 50 that is provided on the driving shaft 11 serving as the rotation center of the revolution orbit R functions as a sun gear, and the first gears 30 and the third gear 60 function as planetary gears.

By doing this, as illustrated in FIG. 5, in a position where the first conveyance path T1, the second conveyance path T2, and the third conveyance path T3 cross each other, the blade 22 can move to the first position P1, and the second position P2 where the gate shaft 21 has rotated on its axis counterclockwise in FIG. 5 from the first position P1, and has revolved along the revolution orbit R clockwise in FIG. 5.

The blade 22 that is located in the first position P1 illustrated in FIG. 6 switches a conveyance route in such a way that the second conveyance path T2 is connected to the first conveyance path T1 and the third conveyance path T3. Therefore, banknote B to be conveyed through the third conveyance path T3 can be conveyed to the second conveyance path T2 in a conveyance direction D1, and banknote B to be conveyed through the first conveyance path T1 can be conveyed to the second conveyance path T2 in a conveyance direction D2.

By doing this, for example, in a case where a jam has occurred in part of the first conveyance path T1 or in other cases, banknote B to be conveyed from the reject part 121 through the first conveyance path T1 and banknote B to be conveyed from the banknote storage cassettes 122 to 125 through the third conveyance path T3 can be conveyed through the second conveyance path T2 to a side of the body 110 illustrated in FIGS. 1 and 2.

In addition, the blade 22 that is located in the second position P2 illustrated in FIG. 7 switches a conveyance route in such a way that the third conveyance path T3 is connected to the first conveyance path T1 and the second conveyance path T2. Therefore, banknote B to be conveyed through the first conveyance path T1 can be conveyed to the third conveyance path T3 in a conveyance direction D3, and banknote B to be conveyed through the second conveyance path T2 can be conveyed to the third conveyance path T3 in a conveyance direction D4.

By doing this, banknote B to be conveyed through the first conveyance path T1 and banknote B to be conveyed through the second conveyance path T2 can be conveyed through the third conveyance path T3 to the banknote storage cassettes 122 to 125.

Alternatively, in a case where the number of pieces of banknote B stored in each of the banknote storage cassettes 122 to 125 is counted by the discrimination part 112, and a counted number of pieces of banknote B are temporarily stored in the reject part 121 in an empty state, the blade 22 is located in the first position P1 illustrated in FIG. 6 to guide, to the second conveyance path T2 in the conveyance direction D1, banknote B to be conveyed from the banknote storage cassettes 122 to 125 through the third conveyance path T3 in such a way that the banknote B will advance to a side of the body 110. This causes the banknote B to be conveyed to the body 110. Then, a certain number of pieces of banknote B that has been counted by the discrimination part 112 are conveyed from the side of the body 110 through the first conveyance path T1 to the reject part 121. In addition, after the counting of the number of pieces of banknote B has been finished, the blade 22 is located in the second position P2 illustrated in FIG. 7 to guide banknote B stored in the reject part 121 in such a way that the banknote B will be conveyed through the first conveyance path T1 and the third conveyance path T3 to the banknote storage cassettes 122 to 125 in the conveyance direction D3.

In the present embodiment described above, a conveyance route switching mechanism 1 and an automated transaction apparatus 100 that includes this conveyance route switching mechanism 1 and is an example of a paper sheet handling apparatus include a driving source 10, a gate 20, a first gear 30, and an internal gear 40. The driving source 10 includes a driving shaft 11. The gate 20 includes a gate shaft 21 and a blade 22 that is provided on this gate shaft 21, and switches conveyance routes of banknote B that is an example of a paper sheet. The first gear 30 is provided on the gate shaft 21. The internal gear 40 meshes with the first gear 30. According to the rotation of the driving shaft 11, the gate shaft 21 rotates on its axis, and revolves with the driving shaft 11 as a rotation center while the first gear 30 and the internal gear 40 mesh with each other.

By doing this, the blade 22 that is provided on the gate shaft 21 can move due to the rotation and revolution of the gate shaft 21. In addition, angles of the rotation and revolution of the gate shaft 21 or a revolution orbit R change according to a module (a value obtained by dividing a diameter of a pitch circle by the number of teeth) or a gear ratio of the first gear 30 and the internal gear 40, and therefore design having a high degree of freedom can be achieved. Therefore, conveyance routes can be complicatedly switched, for example, in such a way that in a position where a first conveyance path T1, a second conveyance path T2, and a third conveyance path T3 cross each other, switching is performed between a conveyance route that connects one conveyance path (for example, the second conveyance path T2) and two remaining conveyance paths (for example, the first conveyance path T1 and the third conveyance path T3) and a conveyance route that connects another conveyance path (for example, the third conveyance path T3) and two remaining conveyance paths (for example, the first conveyance path T1 and the second conveyance path T2). Accordingly, by making it complicated to switch conveyance routes, the number of conveyance paths in the automated transaction apparatus 100 is reduced, and this enables a reduction in a cost and space saving. Moreover, a single conveyance route switching mechanism 1 can switch conveyance routes, and this enables a reduction in a cost and further space saving. Therefore, according to the present embodiment, conveyance routes can be arbitrarily switched in a space-saving configuration.

In addition, in the present embodiment, the conveyance route switching mechanism 1 further includes a second gear 50 that is provided on the driving shaft 11, and a third gear 60 that is provided on the gate shaft 21 and meshes with the second gear 50.

This enables design having a higher degree of freedom by adjusting a module or a gear ratio of the second gear 50 and the third gear 60, in comparison with, for example, an aspect where the third gear 60 is omitted, and the second gear 50 meshes with the first gear 30.

In addition, in the present embodiment, the internal gear 40 is provided with teeth 41 that mesh with the first gear 30 within a range that is less than 180 degrees, and has a fan shape.

This enables a reduction in size of the internal gear 40 in comparison with an aspect where a circular internal gear is used, and therefore further space saving can be achieved.

Note that the present invention is not limited to the embodiment described above with no change, and components can be varied and embodied. For example, various inventions can be made by appropriately combining the plurality of components disclosed in the present embodiment. As described above, various variations or applications of the invention can be made without departing from the spirit of the invention.

The invention claimed is:

1. A conveyance route switching mechanism comprising:

a driving source that includes a driving shaft;

a gate that includes a gate shaft, and a blade that is provided on the gate shaft, the gate switching conveyance routes of paper sheets;

a first gear that is provided on the gate shaft; and an internal gear that meshes with the first gear, wherein according to rotation of the driving shaft, the gate shaft rotates on an axis of the gate shaft, and revolves with the driving shaft as a rotation center while the first gear meshes with the internal gear.

2. The conveyance route switching mechanism according to claim 1, further comprising:

a second gear that is provided on the driving shaft; and a third gear that is provided on the gate shaft, and meshes with the second gear.

3. The conveyance route switching mechanism according to claim 1, wherein the internal gear is provided with teeth within a range that is less than 180 degrees, the teeth meshing with the first gear, and the internal gear has a fan shape.

4. The conveyance route switching mechanism according to claim 2, wherein the internal gear is provided with teeth within a range that is less than 180 degrees, the teeth meshing with the first gear, and the internal gear has a fan shape.

5. A paper sheet handling apparatus comprising a conveyance route switching mechanism, wherein the conveyance route switching mechanism includes:

a driving source that includes a driving shaft;

a gate that includes a gate shaft, and a blade that is provided on the gate shaft, the gate switching conveyance routes of paper sheets;

a first gear that is provided on the gate shaft; and an internal gear that meshes with the first gear, and according to rotation of the driving shaft, the gate shaft rotates on an axis of the gate shaft, and revolves with the driving shaft as a rotation center while the first gear meshes with the internal gear.

* * * * *